US007713110B2

(12) United States Patent
Lampka et al.

(10) Patent No.: US 7,713,110 B2
(45) Date of Patent: May 11, 2010

(54) LOCKING RANDOM ORBITAL DUAL-ACTION HEAD ASSEMBLY

(75) Inventors: Mark Lampka, East Amherst, NY (US); Matthew A. Giles, Amherst, NY (US)

(73) Assignee: Dynabrade, Inc., Clarence, NY (US)

( * ) Notice: Subject to any disclaimer, the term of this patent is extended or adjusted under 35 U.S.C. 154(b) by 0 days.

(21) Appl. No.: 11/516,003

(22) Filed: Sep. 5, 2006

(65) Prior Publication Data

US 2008/0057842 A1 Mar. 6, 2008

(51) Int. Cl.
*B24B 23/02* (2006.01)

(52) U.S. Cl. ..... 451/357; 451/344; 451/353; 451/359; 15/49.1; 30/166.3

(58) Field of Classification Search ..... 452/344, 452/353, 357, 359, 350, 340; 451/344, 353, 451/357, 359, 350, 340; 15/49.1, 98; 30/166.3, 30/347, 388, 478; 409/234, 232
See application file for complete search history.

(56) References Cited

U.S. PATENT DOCUMENTS

| | | | | | |
|---|---|---|---|---|---|
| 2,794,303 | A | | 6/1957 | Wickes | |
| 3,334,448 | A | | 8/1967 | Alexander | |
| 3,418,761 | A | | 12/1968 | Sheps | |
| 3,482,362 | A | * | 12/1969 | Bangerter et al. | 451/357 |
| 3,533,193 | A | | 10/1970 | Dudek et al. | |
| 4,380,092 | A | * | 4/1983 | Brothers | 15/229.12 |
| 4,489,525 | A | * | 12/1984 | Heck | 451/344 |
| 4,516,358 | A | | 5/1985 | Marton et al. | |
| 4,854,085 | A | * | 8/1989 | Huber | 451/357 |
| 4,924,636 | A | * | 5/1990 | Hoffman | 451/357 |
| 5,347,673 | A | * | 9/1994 | Nickels, Jr. | 15/97.1 |
| 5,823,862 | A | * | 10/1998 | Heidelberger | 451/344 |
| 5,885,146 | A | | 3/1999 | Cockburn | |
| 6,132,300 | A | | 10/2000 | Martin | |
| 6,206,771 | B1 | * | 3/2001 | Lehman | 451/357 |
| 6,475,066 | B2 | | 11/2002 | Panagian | |
| 6,485,360 | B1 | * | 11/2002 | Hutchins | 451/357 |
| 6,749,493 | B2 | * | 6/2004 | Wuensch | 451/357 |
| 6,974,370 | B2 | * | 12/2005 | Hutchins | 451/357 |
| 7,022,002 | B2 | | 4/2006 | Lampka et al. | |
| 2002/0119732 | A1 | | 8/2002 | Panagian | |
| 2003/0109207 | A1 | | 6/2003 | Wuensch | |
| 2003/0143935 | A1 | | 7/2003 | Huber | |
| 2003/0228833 | A1 | | 12/2003 | Boyer | |
| 2004/0058632 | A1 | | 3/2004 | Boyer | |
| 2004/0229555 | A1 | | 11/2004 | Hutchins | |

* cited by examiner

*Primary Examiner*—Joseph J Hail, III
*Assistant Examiner*—Robert Scruggs
(74) *Attorney, Agent, or Firm*—Simpson & Simpson, PLLC

(57) ABSTRACT

A head assembly for a rotary tool, comprising a body arranged for connection to a drive means, the drive means rotatable about a first axis of rotation; a rotatable element arranged for connection to a pad assembly, the rotatable element rotatable about a second axis of rotation disposed substantially parallel to the first axis of rotation; and, a locking assembly arranged to lock the rotatable element to the body to prevent rotation of the rotatable element relative to the body about the second axis of rotation.

12 Claims, 5 Drawing Sheets

LOCKING RANDOM ORBITAL DUAL-ACTION HEAD ASSEMBLY

FIELD OF THE INVENTION

The present invention relates generally to a lockable random orbital dual-action head assembly. More particularly, the present invention relates to a locking assembly arranged to lock a rotatable element to prevent rotation of the rotatable element relative to the head assembly about an axis of rotation.

BACKGROUND OF THE INVENTION

Orbital abrading tools are well-known and generally comprise a portable, manually manipulatable housing, a motor supported by the housing and having or being coupled to a drive shaft driven for rotation about a first axis, and an assembly for mounting a pad for abrading or polishing a work surface for orbital movement about the first axis. In a random orbital abrading tool, the assembly serves to additionally mount the pad for free rotational movement about a second axis, which is disposed parallel to the first axis.

The assembly typically includes a head portion coupled for driven rotation with the drive shaft about the first axis and defining a mounting recess having an axis arranged coincident with the second axis, a bearing supported within the mounting recess, and means for connecting the pad to the bearing for rotation about the second axis.

Locking mechanisms for orbital abrading tools are known in the art and described in U.S. Pat. No. 6,749,493 (Wuensch); U.S. Pat. No. 6,974,370 (Hutchins); U.S. Pat. No. 6,485,360 (Hutchins); and, U.S. Pat. No. 5,823,862 (Heidelberger. The locking mechanisms are also known as spindle-locks in the art.

U.S. Pat. No. 6,749,493 (Wuensch) discloses a spindle-lock using a circumferential slider to engage at least one pin to lock the mechanism. By moving the slider circumferentially, a spring retained pin will be forced to vertically engage a hole in a gear wheel, locking the spindle. Wuensch shows a one-piece design for both the motor assembly and the head assembly. Thus, a new tool would be necessary for use with a different head assembly (such as a non-orbital head or a grinder wheel). Furthermore, the circumferential slider comprises many components, increasing the cost of manufacturing and overall weight of the tool.

The same deficiency is present in both U.S. Pat. No. 6,485,360 (Hutchins), and U.S. Pat. No. 5,823,862 (Heidelberger). Although they have different forms of locking mechanisms, the locking mechanism, head assembly, and rotatable means about a second axis are permanently affixed to the abrading tool housing. This broad incorporation restricts the capabilities of the tool. Thus, a new tool would be necessary for use with a different head assembly (such as a non-orbital head or a grinder wheel).

U.S. Pat. No. 6,974,370 (Hutchins '370) presents a similar deficiency. Hutchins '370 shows a spindle lock for an orbital abrading or polishing tool. The head assembly is removable from the abrading tool, but the locking mechanism and means for orbital motion are structural components of the abrading tool housing. Thus, a new tool would still be necessary for a non-orbital head or a grinder wheel.

Furthermore, the locking mechanisms, or spindle-locks, described in the references above can be awkward to manipulate by a user wearing work gloves. Also, the locking mechanisms can be engaged accidentally by the user while the tool is in operation, resulting in excessive wear of the locking mechanism components and reducing the lifetime of the rotary tool and its components.

What is needed then is a locking random orbital dual-action head assembly wherein the rotatable means about an orbital axis and locking mechanism are structural components of the head assembly so that the head assembly can be used with a standard rotary tool. Thus, a single rotary tool can be used and different head assemblies can be attached for various uses. Also, costs can be reduced as individual head assemblies or rotary tools can be repaired or replaced independent of an entire head-assembly/rotary tool combination as in the prior art.

What is also needed is a head assembly comprising a locking mechanism that can not easily be accidentally locked while the tool is in operation, reducing unnecessary wear on the head assembly's or rotary tool's components.

SUMMARY OF THE INVENTION

The invention broadly comprises a removable head assembly for a rotary tool, including a body arranged for connection to a drive means, the drive means rotatable about a first axis of rotation; a rotatable element arranged for connection to a pad assembly, the rotatable element rotatable about a second axis of rotation disposed substantially parallel to the first axis of rotation; and, a locking assembly arranged to lock the rotatable element to the body to prevent rotation of the rotatable element relative to the body about the second axis of rotation.

In some aspects, the head assembly includes a first element displaceable to rotationally lock the rotatable element, and a second element engageable with the first element and displaceable to control the displacement of the first element and the locking assembly includes an elastically deformable element arranged to urge the first element in a first direction. The second element is engageable with the first element to urge the first element in a second direction, opposite the first direction, to lock the rotatable element with the body.

In some aspects, the rotatable element includes at least one receiving feature engageable with the first element, the pad assembly includes a pad base and an abrasive pad, or the pad base and the abrasive pad are secured to one another by means of a hook and loop fastening system. In some aspects, the removable head assembly includes a rotary tool. In some aspects, the rotary tool has an air powered motor. In some aspects, the removable head assembly includes a coupling for detachably securing the head assembly to a rotary tool and the coupling is a threaded connection or a socket connection. In some aspects, the removable head assembly includes a counterbalance secured to the body.

The invention also broadly comprises head assembly for a rotary tool including: a body connected to a drive means for the rotary tool, the drive means rotatable about a first axis of rotation; a rotation means disposed in the body for rotation about a second axis parallel to the first axis, the rotation means comprising a latitudinal portion extending substantially perpendicular to the second axis and comprising at least one receiving aperture; and, a locking mechanism comprising substantially longitudinal first and second components slidingly engaged with the body and slidingly engaged one with the other, wherein the first component is arranged to slide parallel to the latitudinal portion to displace the second component in a first direction substantially parallel to the second axis to engage the second latitudinal component with the at least one receiving aperture to rotationally lock the rotation means with respect to the body.

The invention further broadly comprises a combination rotary tool and removable head assembly, comprising: a rotary tool having a handle, drive means, and means for receiving a removable head assembly; and a removable head assembly operatively arranged to be detachably secured to the rotary tool. The assembly includes: a body arranged for connection to the drive means, the drive means rotatable about a first axis of rotation; a rotatable element arranged for connection to a pad assembly, the rotatable element rotatable about a second axis of rotation disposed substantially parallel to the first axis of rotation; and a locking assembly arranged to lock the rotatable element to the body to prevent rotation of the rotatable element relative to the body about the second axis of rotation.

The invention broadly comprises a combination rotary tool and head assembly, including: a rotary tool having a handle, drive means, and means for securing a head assembly; and, a head assembly secured to the rotary tool. The assembly includes: a body connected to a drive means for the rotary tool, the drive means rotatable about a first axis of rotation; a rotation means disposed in the body for rotation about a second axis parallel to the first axis, the rotation means comprising a latitudinal portion extending substantially perpendicular to the second axis and comprising at least one receiving aperture; and a locking mechanism including substantially longitudinal first and second components slidingly engaged with the body and slidingly engaged one with the other, wherein the first component is arranged to slide parallel to the latitudinal portion to displace the second component in a first direction substantially parallel to the second axis to engage the second latitudinal component with the at least one receiving aperture to rotationally lock the rotation means with respect to the body.

A general objective of the present invention is to provide a removable head assembly with a means for restricting orbital rotation.

A further object of the present invention is to minimize the size, weight, and cost of a locking random orbital dual-action head assembly.

These and other objects, features and advantages of the present invention will become readily apparent to those having ordinary skill in the art upon a reading of the following detailed description of the invention in view of the drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
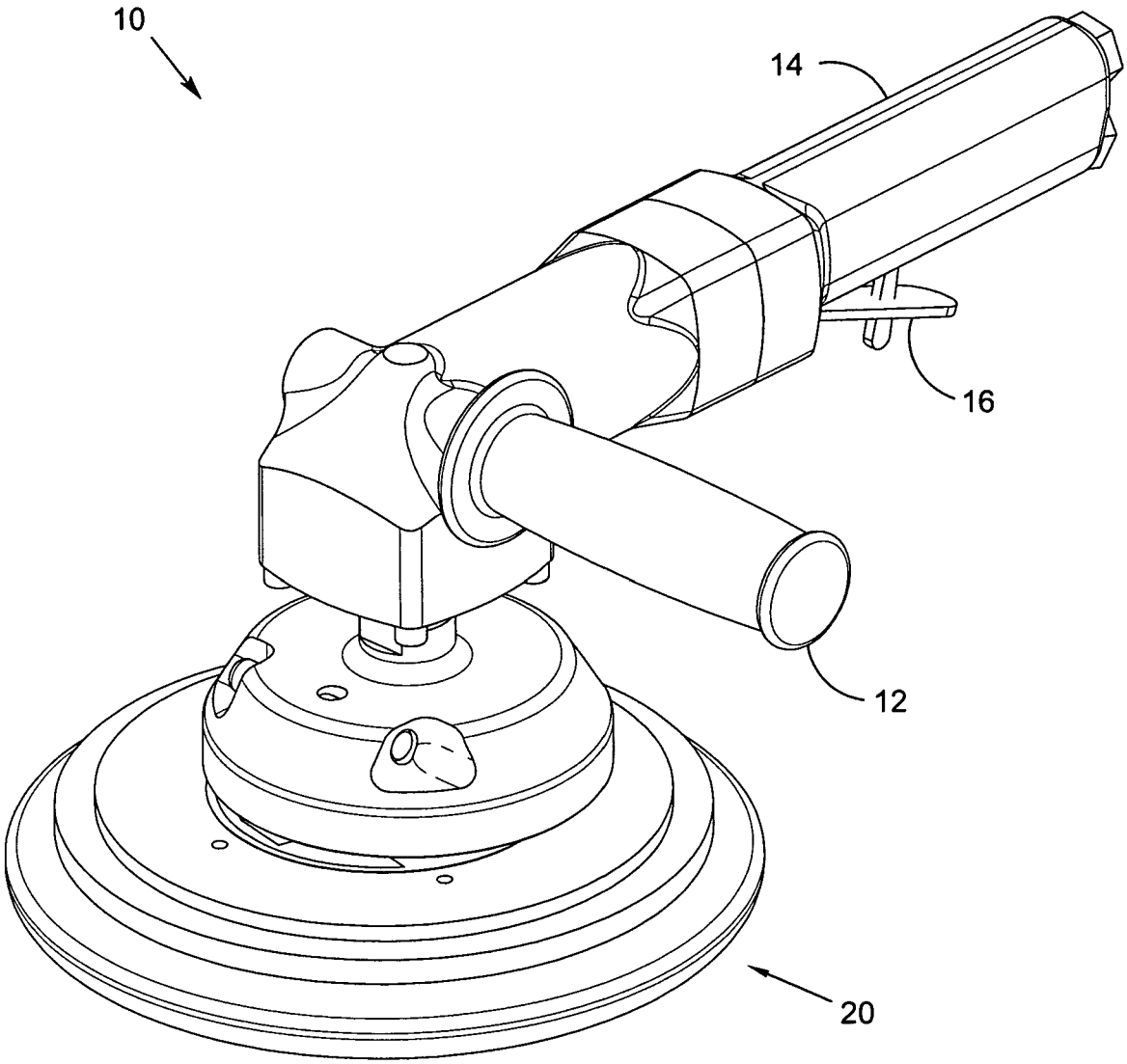
FIG. 1 is a perspective view of a present invention removable locking random orbital dual action head assembly connected to a rotary tool.

FIG. 1 is a perspective view of rotary tool 10 connected to removable locking random orbital dual action head assembly 20 (hereinafter "head assembly 20"). Rotary tool 10 in a preferred embodiment is a compressed air powered tool, but it should be appreciated that any type of rotary tool could be used. For example, an electrically powered rotary tool could be used. In a preferred embodiment, rotary tool 10 comprises first handle 12, second handle 14, and trigger 16, which triggers air flow to provide power to rotary tool 10.

Figure 2:
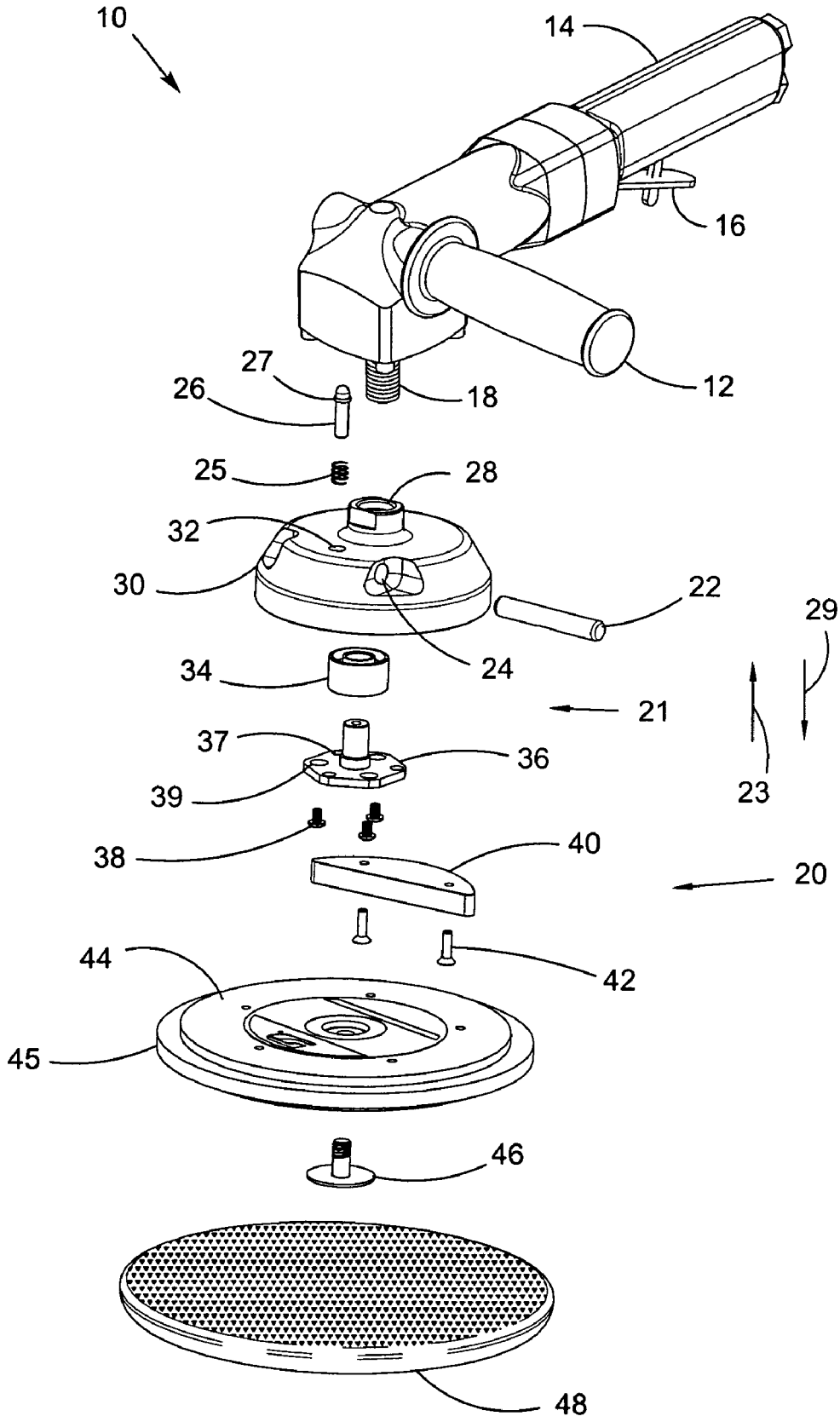
FIG. 2 is an exploded view of the removable locking random orbital dual action head assembly and rotary tool shown in FIG. 1.

FIG. 2 is an exploded view of removable locking random orbital dual action head assembly 20 and rotary tool 10 shown in FIG. 1.

Figure 3:
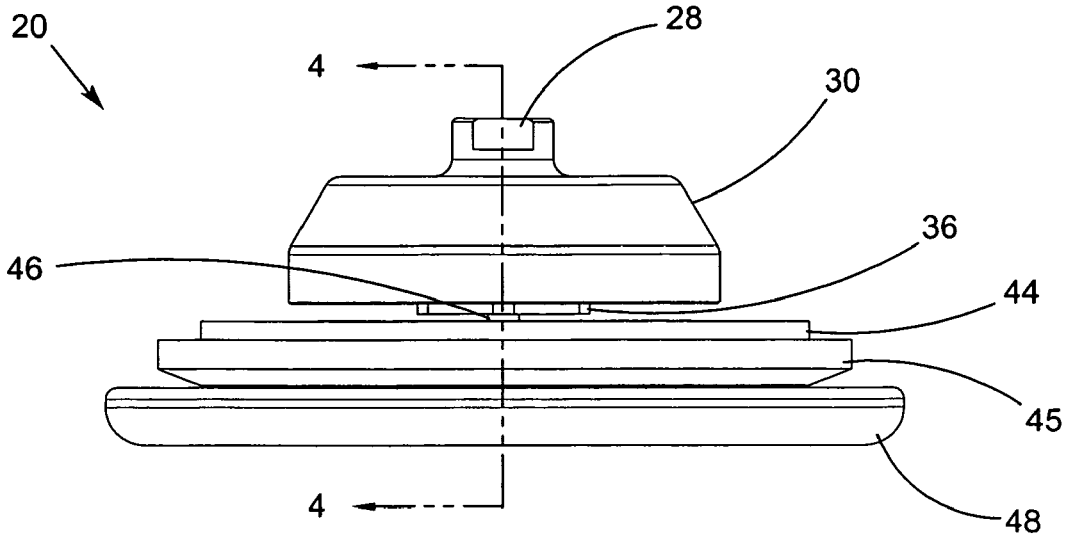
FIG. 3 is a front view of the removable locking random orbital dual action head assembly shown in FIG. 1.

FIG. 3 is a front view of removable locking random orbital dual action head assembly 20 shown in FIG. 1.

Figure 4:
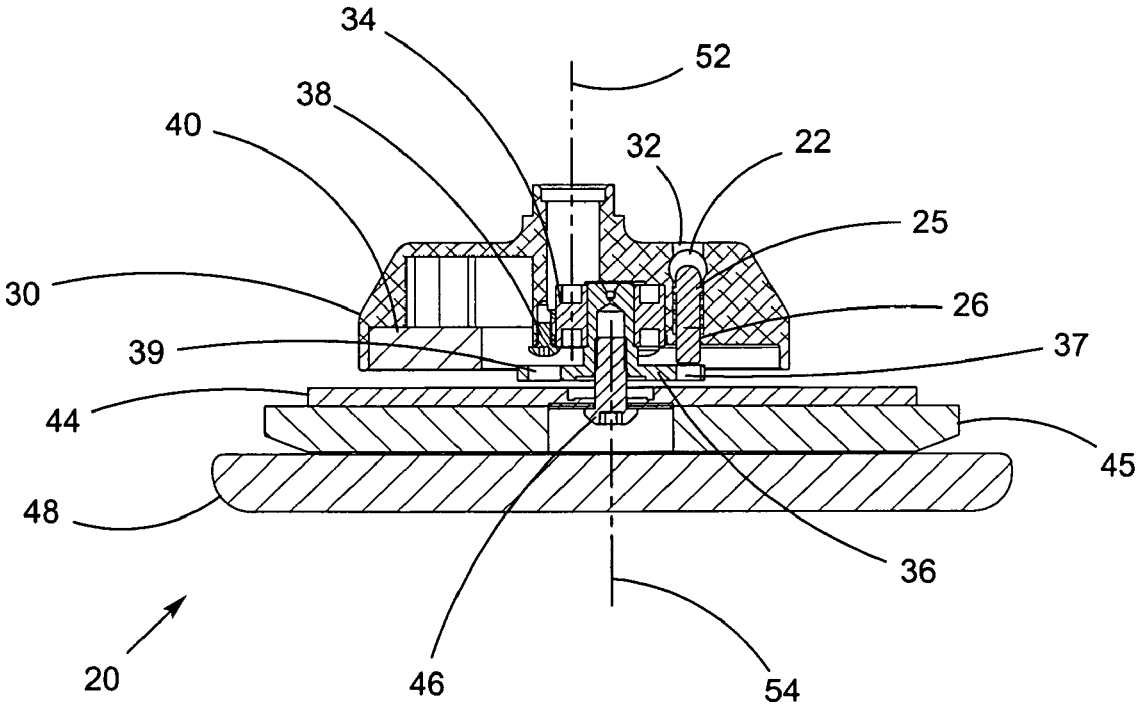
FIG. 4 is a cross sectional view of the removable locking random orbital dual action head assembly shown in FIG. 3 taken along Line 4-4 in FIG. 3.

FIG. 4 is a cross sectional view of removable locking random orbital dual action head assembly 20 shown in FIG. 3 taken along Line 4-4 in FIG. 3. The following should be viewed in light of FIGS. 1 through 4. Rotary tool 10 includes threaded screw 18 for attachment to head assembly 20 at threaded port 28. This connection at threaded screw 18 and threaded port 28 provides first axis of rotation 52 for orbital motion. First axis of rotation 52 is most clearly shown in FIG. 4. Referring back to FIG. 2, it should be appreciated that any means between rotary tool 10 and head assembly 20 could be used. A threaded connection is preferred, but a socket connection (such as a connection used for socket wrenches as known in the art) or any other form of coupling known in the art used in rotation applications could be used.

The following is a broad overview of assembly 20, further details are provided below. Assembly 20 includes body, or casing 30, rotatable element, or spindle, 36, and locking assembly 21. Casing 30 is arranged for connection to a drive means, for example, screw 18, rotatable about a axis of rotation 52. Element 36 is arranged for connection to a pad assembly, for example pad assembly 45, and is rotatable about axis of rotation 54, disposed substantially parallel to axis of rotation 52. Locking assembly 21 is arranged to lock rotatable element 36 to body 30 to prevent rotation of element 36, relative to body 30, about axis of rotation 54.

Locking assembly 21 includes element, or pin, 26 displaceable to rotationally lock rotatable element 36. Assembly 21 also includes element 22, engageable with element 26 and displaceable to control the displacement of element 26, and elastically deformable element 25 arranged to urge element 26 in direction 23. In some aspects, element 25 is a spring. However it should be understood that any elastically deformable element known in the art can be used. As further described below, element 22 is engageable with element 26 to urge element 26 in direction 29, to lock element 36 with body 30. Rotatable element 36 includes at least one receiving feature engageable with element 26. The receiving feature can be an opening, for example, opening 37, or an indentation.

Casing 30 of assembly 20 includes threaded port 28, pin hole 32, and sliding bolt hole 24. Pin hole 32 is operatively arranged to accept pin 26 and retention spring 25. Retention spring 25 retains pin 26 in a disengaged position, with respect to element 36, until sliding bolt 22 is engaged.

Pin 26 includes rib 27, upon which retention spring 25 rests. Sliding bolt hole 24 is operatively arranged to accept sliding bolt 22. In some aspects, sliding bolt 22 protrudes through both sides of sliding bolt hole 24 so that an operator can access both ends of slide sliding bolt 22 to move the bolt from an engaged to a disengaged position. In some aspects, sliding bolt 22 protrudes through one side substantially more so that the other side dependent upon whether sliding bolt 22 is in the engaged or disengaged position. Sliding bolt 22 protrudes through to a first side substantially more than a second side in the engaged position, and protrudes through the second side substantially more than the first side in the disengaged position. The engaged and disengaged positions are further described below. The preceding configuration enables easy engagement or disengagement of the sliding bolt 22 when the operator is wearing work gloves.

Sliding bolt 22 rotates with head assembly 20 when rotary tool 10 is engaged. This rotation inhibits a user from accidentally engaging sliding bolt 22 while the tool is being used and causing unnecessary wear on the components.

Casing 30 acts as a shell and structural support for ball bearing assembly 34, spindle 36, and counterbalance 40. Ball bearing assembly 34 provides for rotation, about axis 54, of spindle 36, base support 44, pad base 45 and pad 48 independent of casing 30. It should be appreciated that any ball bearing means known in the art can be used for ball bearing assembly 34. It also should be appreciated that any rotation support means known in the art can be used for rotation about axis 54, for example a bushing arrangement (not shown).

In some aspects, spindle 36 includes a plurality of holes or indentations. Some of the holes, for example, holes 37, are engagement holes and some of the holes, for example, holes 39 are bearing retention holes. It should be appreciated that any number of holes could be used. In some aspects, three holes for engagement holes 37 and three holes for retention holes 39 are used for ease of balancing and manufacturing. Balancing is very important in rotary tools in order to minimize undesirable vibration. Engagement holes 37 are about the same size as the diameter of pin 26 and are operatively arranged to accept pin 26. Retention holes 39 are of a size larger that the heads of retention screws 38. Retention screws 38 hold ball bearing assembly 34 to casing 30. It should be appreciated that any means of attachment known in the art can be used. In some aspects, retention screws 38 in a set of three are used for balancing and ease of manufacturing. Pin hole 32 and holes 37 are at a same radial distance from axis 54 to facilitate the alignment of pin 26 and the holes as further described below.

In some aspects, counterbalance 40 is bolted into casing 30 by means of bolts 42 to provide a balanced rotation of both orbital and rotational motion and thereby reduce vibrations.

Figure 5:
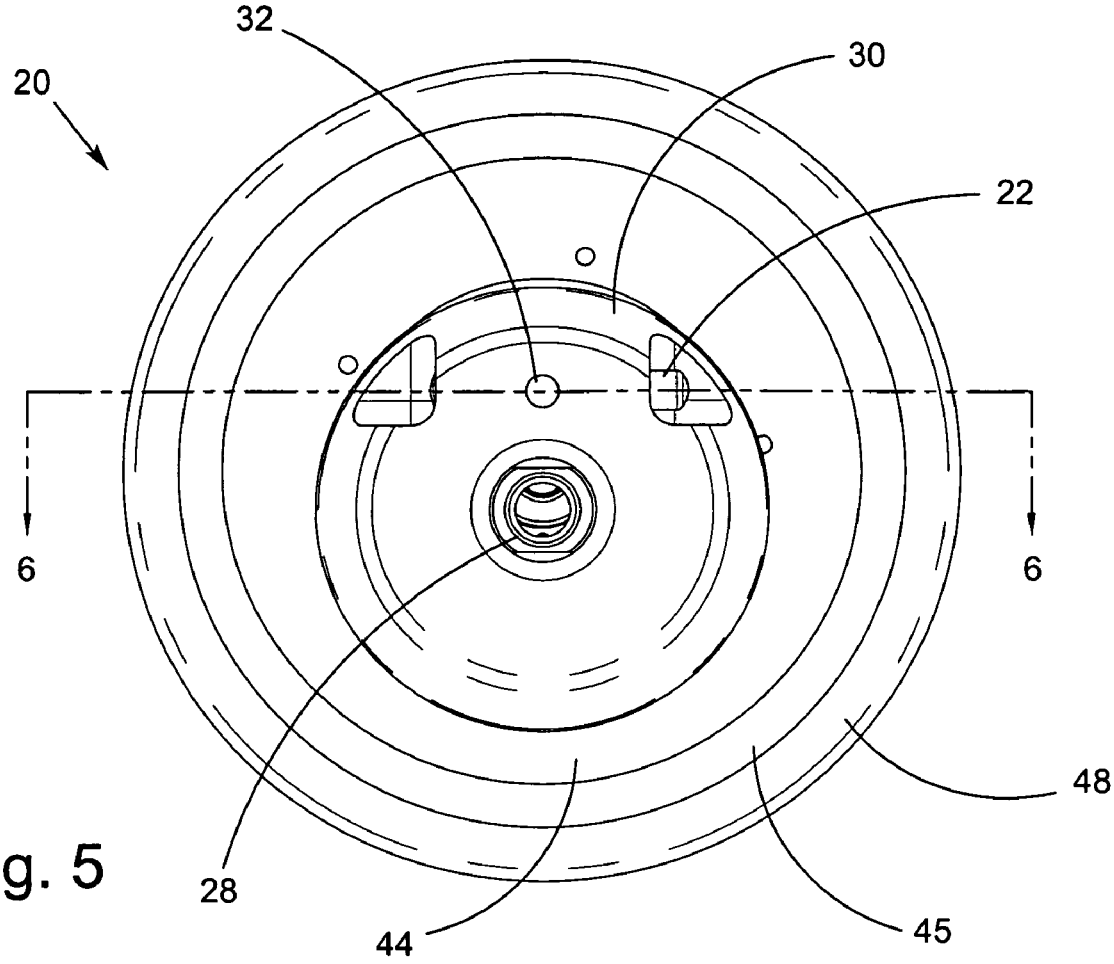
FIG. 5 is a top view of the removable locking random orbital dual action head assembly shown in FIG. 1.

FIG. 5 is a top view of removable locking random orbital dual action head assembly 20 shown in FIG. 1.

Figure 6:
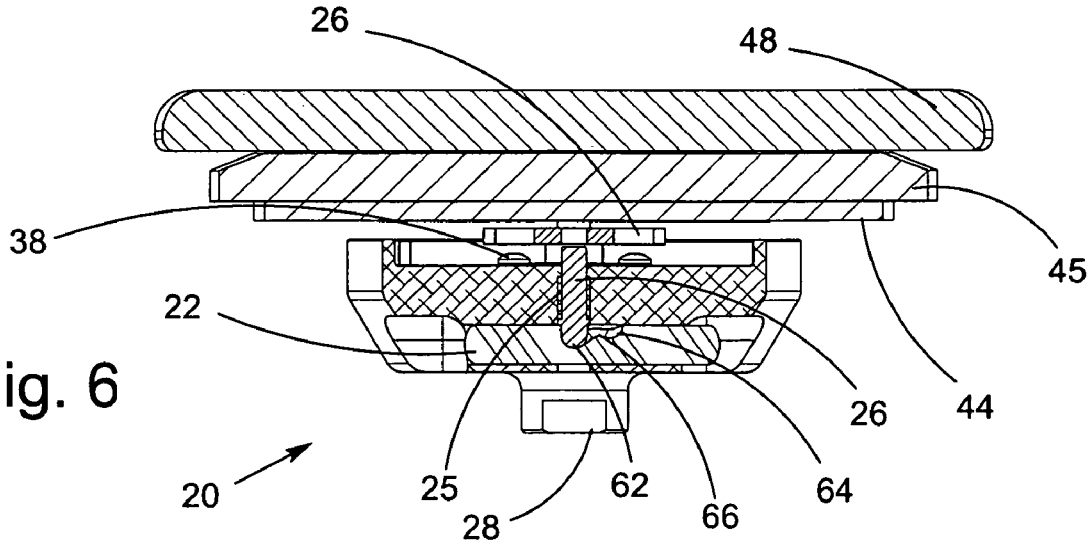
FIG. 6 is a cross sectional view of the removable locking random orbital dual action head assembly shown in FIG. 5 taken along Line 6-6 in FIG. 5.

FIG. 6 is a cross sectional view of removable locking random orbital dual action head assembly 20 shown in FIG. 5 taken along Line 6-6 in FIG. 5.

Figure 7:
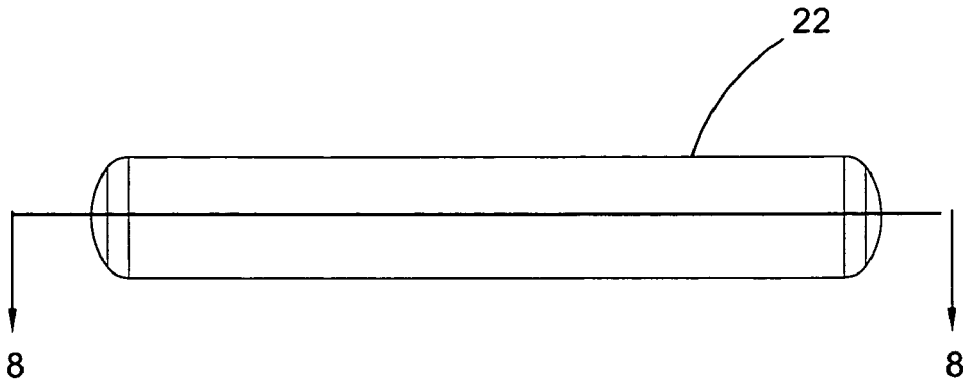
FIG. 7 is a top view of the sliding bolt shown in FIG. 1.

FIG. 7 is a top view of sliding bolt 22 shown in FIG. 1.

Figure 8:
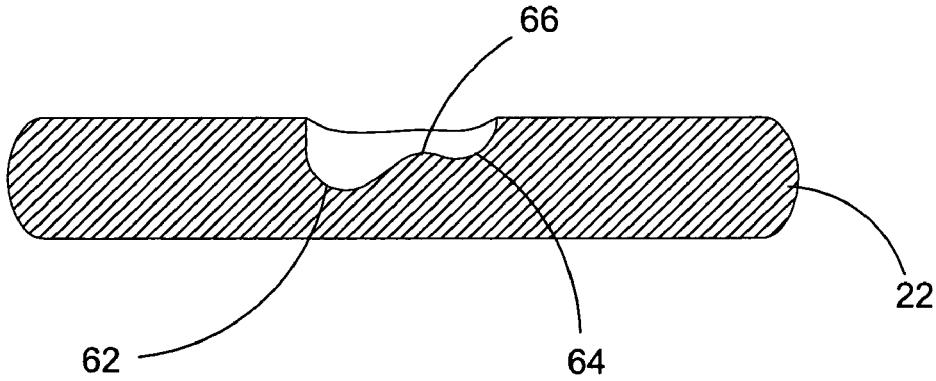
FIG. 8 is a side view of the sliding bolt shown in FIG. 7 taken along Line 8-8 in FIG. 7; and, FIG. 9 is an illustrative view of a present invention locking mechanism illustrating the sliding bolt of FIG. 8 engaging a pin into an engagement hole.

FIG. 8 is a side view of sliding bolt 22 shown in FIG. 7 taken along Line 8-8 in FIG. 7.

Figure 9:
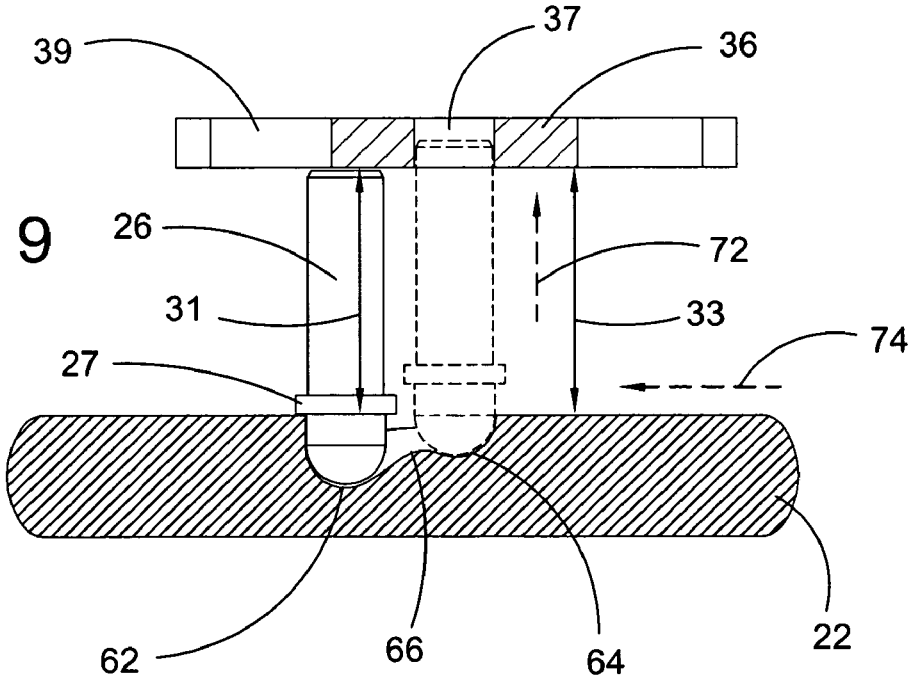

FIG. 9 is an illustrative view of present invention locking assembly, or locking mechanism, 21 illustrating sliding bolt 22 of FIG. 8 engaging pin 26 to urge pin 26 into an engagement hole. The following should be viewed in light of FIGS. 1 through 9. The operation of locking assembly 21 is now described in further detail. Sliding bolt 22 has two graduated slots, slot 62 for a disengaged position of pin 26, and slot 64 for an engaged position of pin 26. Ridge 66 is disposed between slots 62 and 64. Ridge 66 inhibits bolt 26 from moving between slots 62 and 64, thereby helping to prevent sliding bolt 22 from sliding pin 26 between engaged slot 64 and disengaged slot 62 without direct user manipulation to overcome the spring force created by retention spring 25. In FIGS. 4 and 6, sliding bolt 22 is in a disengaged position with pin 26 in slot 62. Slots 62 and 64, with ridge 66 between them, has been previously presented in U.S. Pat. No. 5,823,862 (Heidelberger), which is incorporated by reference herein.

As noted above, elastically deformable element, or spring, 25 applies constant force to pin 26 to urge the pin in direction 23. This force tends to keep pin 26 engaged with which ever of slots 62 or 64 in which the pin is disposed. In the unlocked mode, pin 22 is positioned so that pin 26 is disposed in slot 62. Length 31 of pin 26 is less than or equal to axial length 33 between pin 22 and element 36, so that in the unlocked mode, pin 26 does not extend far enough in direction 29 to engage element 36 and element 36 is able to rotate without substantive interference from pin 26.

To switch to the locking mode, pin 22 is laterally displaced so that pin 26 shifts to slot 64, displacing pin in direction 29 and into opening 37, as shown in FIG. 9. For example, length 31 is sufficient to enable pin 26 to extend through opening 37 once pin 26 and opening 37 are aligned. To attain this alignment from the unlocked position, lateral pressure is applied to the appropriate end of pin 22, for example, in direction 74 in FIG. 9 and assembly 20 (and subsequently element 36) is rotated about axis 54 until an opening 37 aligns with pin 26. At that point, the lateral pressure causes pin 22 to slide so that pin 26 displaces to slot 64 and is pushed into opening 37, locking element 37 with respect to casing 30 through which pin 26 passes. Thus, by rotating head assembly 20 around second axis 54, pin 26 will eventually align with one of the three engagement holes 37.

The locking mechanism herein described locks the rotation of the pad assembly, which comprises base support 44, pad base 45, and pad 48 about second axis 54. Thus, the pad assembly will only rotate about first axis 52 with casing 30.

In some aspects, components of head assembly 20 are machined from metal. In some aspects, other material including, but not limited to composites, plastics, and combinations thereof are used to make the components. In some aspects both metal and one or more of the other materials are used to form the components. It should also appreciated that any form of metal processing could be used, including casting, pressing, welding, machining, and combinations thereof. In some aspects, machining is used to increase precision.

Base support 44 and pad base 45 are affixed to each other by glue, but it should be appreciated that any means of attachment known in the art can be used. Base support 44 is made of a non-pliable material that provides structural support for pad base 45 and also a means for pad bolt 46 to be tightened to spindle 36. Pad base 45 is made of a pliable material that will provide for a dampened interface between a work surface and the user. Preferably, base support 44 is made from plastic and pad base 45 is a high density foam or similar rubber, but it should be appreciated that any similar materials could be used for either base support 44 or pad base 45. Base support 44 is attached to spindle 36 by means of pad bolt 46. Pad bolt 46 is recessed within pad base 45 and is most clearly shown in FIG. 4.

Referring back to FIG. 2, pad base 45 preferably comprises either a hook or loop surface. Alternatively, pad 48 comprises a loop or hook surface so that pad base 45 and pad 48 may be attached by a hook and loop interface. This allows for a quick and easy replacement of pad 48 or change exchanging pad 48 with an abrasive pad having different abrasive properties.

It should be appreciated that any type of pad 48 could be used. Pad 48 could be a piece of sand paper of any grit size. Alternatively, pad 48 could be a polishing pad, buffing pad, or any other pad known in the art.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What is claimed is:

1. A removable head assembly for a rotary tool, comprising:

a body arranged for connection to a drive means and including first and second openings, said drive means rotatable about a first axis of rotation;

a rotatable element arranged for connection to a pad assembly, said rotatable element rotatable about a second axis of rotation disposed substantially parallel to said first axis of rotation;

a first element for a locking assembly; and, a second element for the locking assembly, wherein the second element includes first and second longitudinal ends extendable beyond an outer surface for the body, wherein the second element is displaceable through the first and second openings in the body, and wherein the second element is displaceable to displace the first element, wherein the displacement of said first element is along a straight line to rotationally lock said rotatable element with respect to the body.

2. The removable head assembly as recited in claim 1, wherein said locking assembly further comprises an elastically deformable element arranged to urge said first element in a first direction and wherein said second element is engageable with said first element to urge said first element in a second direction, opposite said first direction, to lock said rotatable element with said body.

3. The removable head assembly as recited in claim 1, wherein said rotatable element further comprises at least one receiving feature engageable with said first element.

4. The removable head assembly as recited in claim 1, wherein said pad assembly further comprises a pad base and an abrasive pad.

5. The removable head assembly as recited in claim 4, wherein said pad base and said abrasive pad are secured to one another by means of a hook and loop fastening system.

6. The removable head assembly as recited in claim 1, further comprising a rotary tool.

7. The removable head assembly as recited in claim 6, wherein said rotary tool has an air powered motor.

8. The removable head assembly as recited in claim 1, further comprising a coupling for detachably securing said head assembly to a rotary tool.

9. The removable head assembly as recited in claim 8, wherein said coupling comprises a threaded connection.

10. The removable head assembly as recited in claim 8, wherein said coupling comprises a socket connection.

11. The removable head assembly as recited in claim 1, further comprising a counterbalance secured to said body.

12. A combination rotary tool and removable head assembly therefore, comprising:

a rotary tool having a handle, drive means, and means for receiving a removable head assembly; and, a removable head assembly operatively arranged to be detachably secured to said rotary tool, comprising:

a body arranged for connection to said drive means and including a bore through the body, said drive means rotatable about a first axis of rotation;

a rotatable element arranged for connection to the body and to a pad assembly, said rotatable element rotatable about a second axis of rotation disposed substantially parallel to said first axis of rotation; and, a locking assembly including:

a first element; and, a second element for the locking assembly, wherein the second element is disposed in the bore, wherein the second element includes first and second longitudinal ends extendable beyond an outer surface of the body and wherein the second element is displaceable in the bore to displace the first element.

* * * * *